US008628228B2

(12) United States Patent
Lundy

(10) Patent No.: US 8,628,228 B2
(45) Date of Patent: Jan. 14, 2014

(54) LIGHT ASSEMBLY AND METHOD OF USE

(76) Inventor: Benton Lundy, Creston, IA (US)

( * ) Notice: Subject to any disclaimer, the term of this patent is extended or adjusted under 35 U.S.C. 154(b) by 524 days.

(21) Appl. No.: 12/713,593

(22) Filed: Feb. 26, 2010

(65) Prior Publication Data

US 2012/0275142 A1 Nov. 1, 2012

Related U.S. Application Data

(60) Provisional application No. 61/221,824, filed on Jun. 30, 2009, provisional application No. 61/156,269, filed on Feb. 27, 2009.

(51) Int. Cl.
*F21V 7/04* (2006.01)

(52) U.S. Cl.
USPC ..... 362/555; 362/577; 362/578; 362/579; 362/109; 362/110; 362/111; 362/112; 362/113; 362/114; 362/115; 362/116; 362/117; 362/118; 362/119; 362/120

(58) Field of Classification Search
USPC ..... 362/555, 577–579, 109–120
See application file for complete search history.

(56) References Cited

U.S. PATENT DOCUMENTS

| | | | | |
|---|---|---|---|---|
| 3,819,925 | A | 6/1974 | Richter et al. | |
| 3,933,118 | A | 1/1976 | Lyons et al. | |
| 4,064,428 | A | 12/1977 | Van Zandt | |
| 4,957,057 | A * | 9/1990 | Marcucci | 116/22 A |
| 6,193,385 | B1 | 2/2001 | Maki et al. | |
| 6,682,202 | B2 * | 1/2004 | Wong | 362/118 |
| 6,758,588 | B2 * | 7/2004 | Hsu | 362/497 |
| 7,021,809 | B2 * | 4/2006 | Iwasa et al. | 362/555 |
| 7,059,743 | B2 | 6/2006 | Niemann | |
| 7,246,927 | B2 | 7/2007 | Wikle et al. | |
| 7,338,189 | B2 | 3/2008 | Kovacik et al. | |
| 7,594,738 | B1 | 9/2009 | Lin et al. | |
| 8,087,421 | B2 * | 1/2012 | Gorey et al. | 135/66 |
| 2002/0191396 | A1 | 12/2002 | Reiff et al. | |
| 2003/0223247 | A1 * | 12/2003 | Karras | 362/555 |
| 2006/0092623 | A1 * | 5/2006 | Irisawa | 362/102 |
| 2008/0130277 | A1 * | 6/2008 | Waters | 362/227 |
| 2009/0147519 | A1 | 6/2009 | Klipstein et al. | |

OTHER PUBLICATIONS

Ikea—Integrated Lighting, "Dioder Battery-operated lamp for drawers", www.ikea.com/us/en/catalog/products/50126605, 1 page.
Ikeasfans Website, "Help with Dioder Lights?", www.ikeafans.com/forums/ikea-hacker/16883-help-dioder-lights.html. Jul. 7, 2008, 3 pages.

(Continued)

*Primary Examiner* — William Carter
(74) *Attorney, Agent, or Firm* — Boardman & Clark LLP

(57) ABSTRACT

A light assembly is provided. The light assembly has a housing having a first end segment carrying an activation mechanism, a second end segment, and a light emitting segment connecting the first and second end segments. A light source is provided in communication with an activation device and arranged to illuminate the light emitting segment. An attachment assembly is arranged for attachment of the light assembly to a carrying device. The attachment assembly is formed by a first receptor and a second receptor, the first and second receptors adapted to receive an attachment device. The attachment assembly may also be formed by a first magnet arranged to attract to the carrying device and a second magnet arranged to attract to the carrying device.

20 Claims, 16 Drawing Sheets

(56) References Cited

OTHER PUBLICATIONS

Pelican Products 9500, "Pelican 9500 Shelter Lighting System", www.pelican.com/lights_detail_print_aalg.php?recordID=9500, 1 page.
Bicycle Lighting, From Wikipedia, http://en.wikipedia.org/wiki/Bicycle_lighting, 14 pages.
Bicycle Lights, www.bikemania.biz/Bicycle_Lights_s/46.htm, 3 pages.
Black & Decker Power Tools, "SnakeLight", www.blackanddecker.com/ProductGuide/Product-Print.aspx?productid=15583, 1 page.
Coleman, "LED MicroPacker Lantern", www.coleman.com/coleman/ColemanCom/detail.asp?CategoryID=1045&product_id . . . , 2 pages.
Cygolite: Products, "New LED Series for 2009-2010", www.cygolite.com/products/index.html, 3 pages.
Glow Sticks, "Glow Sticks & LED Light Sticks", http://glowproducts.com/glowsticks/, 3 pages.
Osram Sylvania, "DOT-it Lights", www.sylyania.com/consumerproducts/automotivelighting/products/dotitlights/ad . . . , 3 pages.
Rope Light LED, "LED Rope Lights", www.budgetlighting.com/flexbrite-led-rope-light.html, 2 pages.
Rope Light, LED, "Rope Lights", www.1000bulbs.com/Rope-Lights/, 2 pages.
Sylvania Dot-It LED Lite Stick, "Battery Powered Light Stick Provides Bright Illumination Anywhere You Go", www.smarthome.com/461BL/Sylvania-DOT-it-LED-Lite-Stick-Blue-72209/p.aspx, 2 pages.

* cited by examiner

LIGHT ASSEMBLY AND METHOD OF USE

CROSS-REFERENCE TO RELATED APPLICATIONS

This application claims priority to U.S. Provisional Application, Ser. No. 61/221,824 filed Jun. 30, 2009, entitled "Safety Light and Method of Use" and claims priority to U.S. Provisional Application, Ser. No. 61/156,259 filed Feb. 27, 2009, entitled "Safety Light and Method of Use" the contents of each of which are incorporated herein by reference in their entirety.

FIELD OF THE INVENTION

The present invention relates to a light assembly, and more specifically, a safety light. The present invention more specifically relates to a mobile safety light for illumination of individuals and vehicles.

BACKGROUND

During low sunlight conditions, for example at dusk and night, persons and vehicles can be exposed to substantial safety hazards. Persons, who may be walking or working, or vehicles, for example bicycles, may be difficult to recognize and see by others. This may pose a risk to the persons or vehicles, especially to others in the area, for example motorists operating motor vehicles. The inability to recognize and see may lead to an increased risk of a physical accident between the person or vehicle and another. The injury to the person or vehicle could be catastrophic, and may lead to death. Accordingly, it would be desirable to have a device which would illuminate persons or vehicles during low sunlight conditions allowing others to recognize and see the person or vehicle.

Lights and light bulbs are well known for use in illumination. Light bulbs generate and emit rays of light in all directions, generally in a three-hundred and sixty (360) degree plane surrounding the light bulb. While practical for illuminating enclosed areas, for example within a structure, light bulbs alone are not practical for illuminating an individual or vehicle, as they emit light in an uncontrolled manner.

Devices are known for use in directing light beams generated by light bulbs in specific directions. For example, a headlight may direct rays of light in a specified direction to illuminate an area. Often headlights may be mounted on vehicles or individuals, for example on the forehead of a person, to illuminate an area. Another example is a flashlight, which may direct rays of light in a specified direction with the added feature of being hand held. While practical, these lights are limited to concentrating and directing light beams to illuminate a specific area or direction.

Devices are known for use in illuminating low light areas in which the device may be removably attached to a structure in or around the low light area. For example, lights may have a hook assembly for hanging on a structure. Other lights may have an adjustable housing, similar to the SNAKE LIGHT® sold by Black & Decker, which may be wrapped around or positioned on a structure. Unfortunately, these devices are not suitable for use on individuals or vehicles.

Devices are known for use in illuminating individuals or vehicles in low sunlight conditions. These devices are chemiluminescent lighting devices, often referred to as "glow sticks." The devices may include a sealed outside tube, often made of plastic, and may contain a mixture of dye and diphenyl oxalate, an ester. Inside the tube is a glass vial containing hydrogen peroxide. A user may apply force to the outside tube to break the inner glass vile and release the hydrogen peroxide. Upon contact, the hydrogen peroxide and diphenyl oxalate react, oxidizing the ester and yielding two molecules of phenol and one molecule of peroxyacid ester. The peroxyacid ester decomposes spontaneously to carbon dioxide, releasing energy that excites the dye, which then de-excites by releasing a photon or ray of light. These devices emit light for a limited amount of time, as once the diphenyl oxalate is completely oxidized, the device is unable to release any additional light. In addition, these devices can not be reused after the chemical reaction is complete due to sealed outside tube and the breaking of the inner glass vial. Accordingly, the device must be disposed of after use.

Accordingly, it would be desirable to provide a light or illumination device and mounting assembly which may connect to a vehicle or person, is removable, generally illuminates a vehicle, area or person for recognition by others, and is reusable.

SUMMARY

A light assembly is provided. The light assembly has a housing having a first end segment carrying an activation mechanism, a second end segment, and a light emitting segment connecting the first and second end segments. A light source is provided in communication with an activation device and arranged to illuminate the light emitting segment. An attachment assembly is arranged for attachment of the light assembly to a carrying device. The attachment assembly is formed by a first receptor and a second receptor, the first and second receptors being adapted to receive an attachment device.

A further light assembly is provided. The light assembly has a housing having a first end segment carrying an activation mechanism, a second end segment, and a light emitting segment connecting the first and second end segments. A light source is provided in communication with an activation device and arranged to illuminate the light emitting segment. An attachment assembly is arranged for attachment of the light assembly to a carrying device. The attachment assembly is formed by a first magnet arranged to attract to the carrying device and a second magnet arranged to attract to the carrying device.

The light assembly, or safety light, or light emitting device according to the foregoing provides a light or illumination device and mounting assembly which may connect to a vehicle or person, is removable, generally illuminates a vehicle, area or person, and is reusable.

BRIEF DESCRIPTION OF THE DRAWINGS

FIGS. 10A and 10C being illustrated in partial transparent views to illustrate components on the interior of the housing and FIG. 10A having absent the interior portion; FIG. 10B being a cross-section view of the housing taken along line 10B-10B of FIG. 10A and FIG. 10D being a cross-section view of the housing taken along line 10D-10D of FIG. 10C.

DETAILED DESCRIPTION

Figure 1:
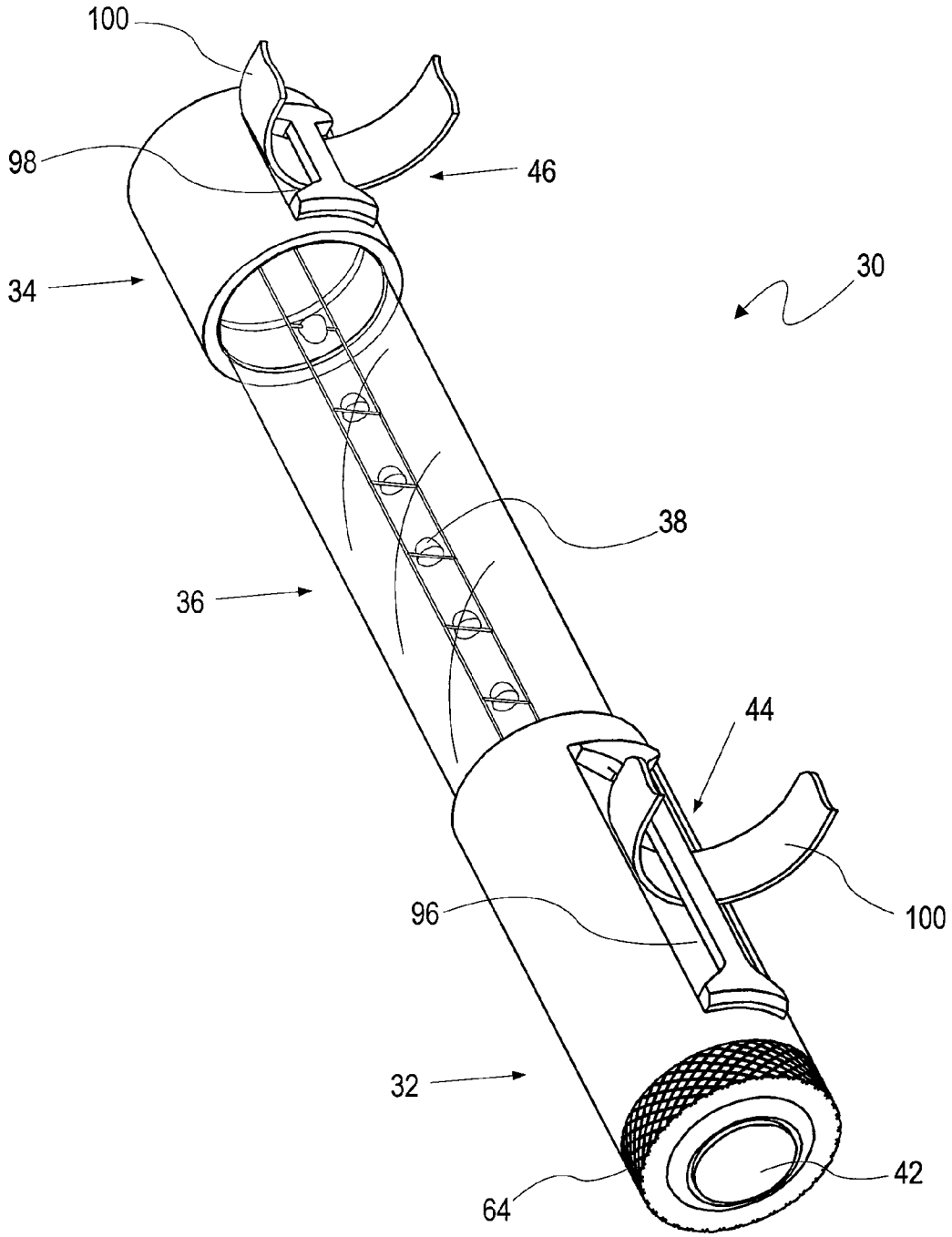
FIG. 1 is an isometric view of a light assembly according to one or more examples of embodiments.

The invention is generally directed to a light emitting device or assembly or safety light for illuminating individuals and vehicles in low sunlight conditions. The Figures illustrate one or more examples of embodiments of the present invention. Although specific examples are provided herein to which the light emitting device is mounted for use, it is appreciated that the light emitting device may be mounted on any suitable, location, device, person or apparel acceptable for the purposes described herein.

A light assembly 30 is provided. As shown generally in FIGS. 1-4, the light assembly 30 is formed of a housing 32, 34, 36 carrying a light source 38, power supply 40 and activation device 42. The housing of the light assembly 30 has a first end portion and a second end portion, or a first end segment 32 and a second end segment 34. A central portion is carried between the first and second end portions. The central portion may be a light emitting segment 36. To this end, the light emitting segment 36 may be transparent, or partially or semi transparent or otherwise adapted to emit light or a wavelength of light. The first end portion or segment 32 carries an activation device 42. The light assembly 30 also includes a light source 38 in communication with the activation device 42. The light source 38 is arranged to illuminate the light emitting segment 36 of the housing. One or more attachment assemblies 44, 46 may be provided for attaching the light assembly 30 to a device 48 so as to carry the light assembly thereon.

As can be seen in FIGS. 1-4, the first end portion is formed of a first housing segment 32 which carries the activation mechanism 42. The illustrated first housing segment 32 is a cylindrical housing, although alternative geometries would not depart from the overall scope of the present invention. The first housing segment 32 has a first end 50 and a second end 52. The first end 50 receives the activation mechanism 42. The second end 52 is adapted to receive the central portion 36 of the light assembly 30. In this regard, the second end 52 may have an internal thread that mates with a corresponding thread on the light emitting segment 36, or may otherwise include an attachment mechanism, such as, but not limited to, a tongue and groove arrangement or may include a roughened or partitioned surface, or may otherwise be sized to secure the first housing segment 32 to the light emitting segment 36 or central portion. Alternatively, the end segments 32, 34 of the housing may engage the central portion 36 of the housing by friction fit. To this end, the housing segments 32, 34, 36 may be removable or separable. The first end portion or segment 32 of the housing may be formed of metal, plastic, or other natural or synthetic substance.

Figure 2:
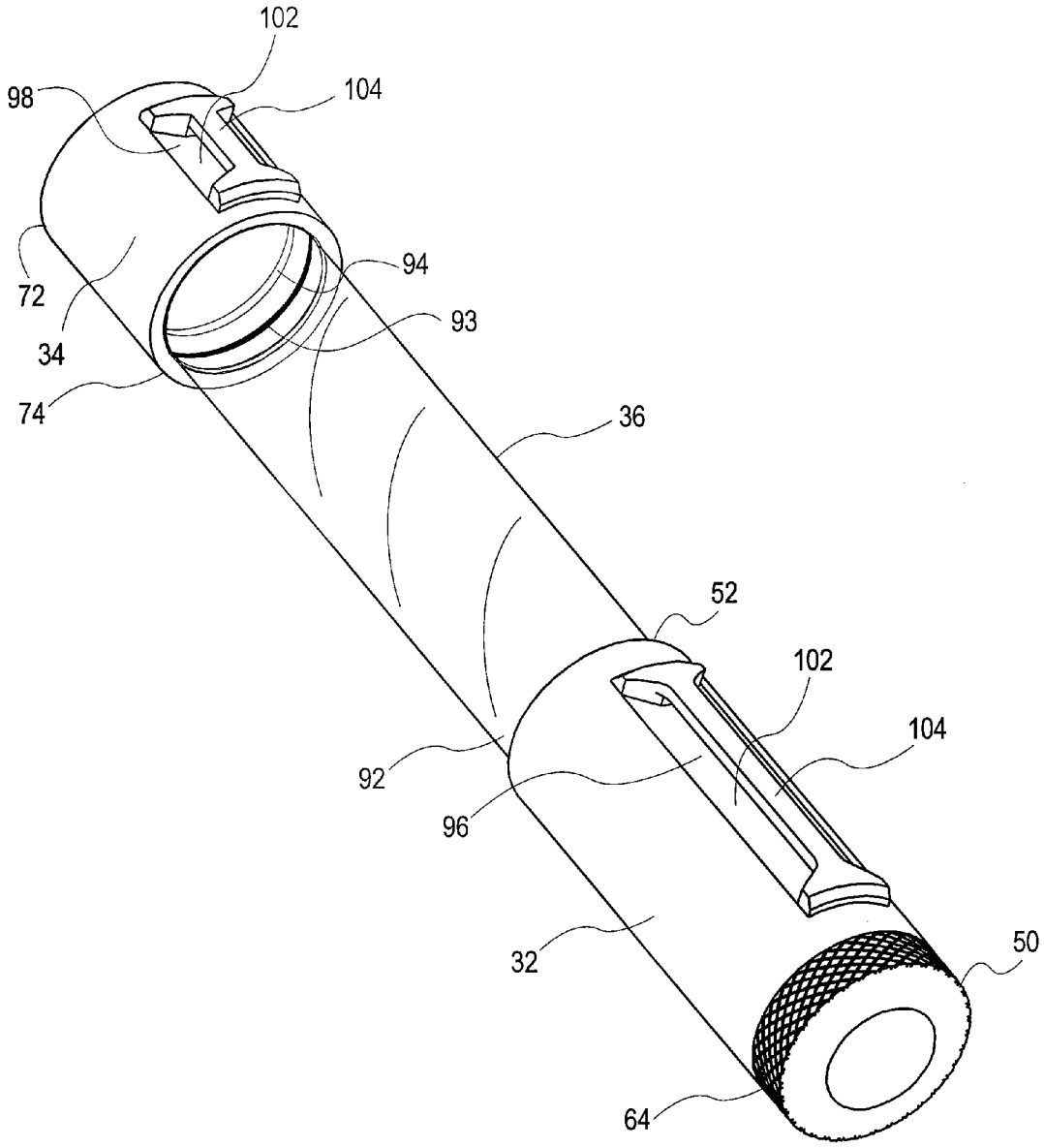
FIG. 2 is an isometric view of the housing of the light assembly shown in FIG. 1.
Figure 3:
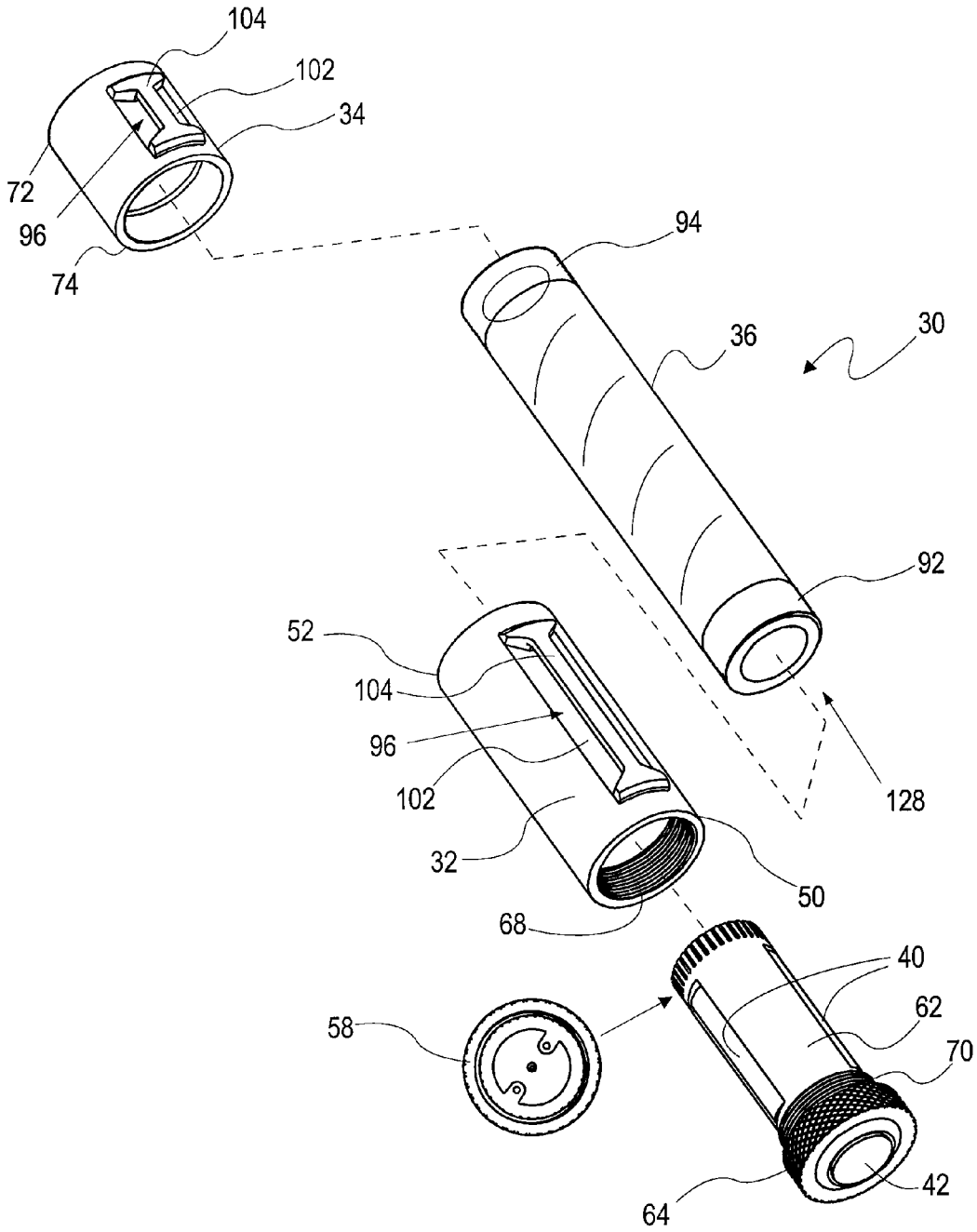
FIG. 3 is an exploded view of light assembly of FIG. 1, showing the first end segment, second end segment and light emitting segment, absent the light source, according to one or more embodiments.
Figure 4:
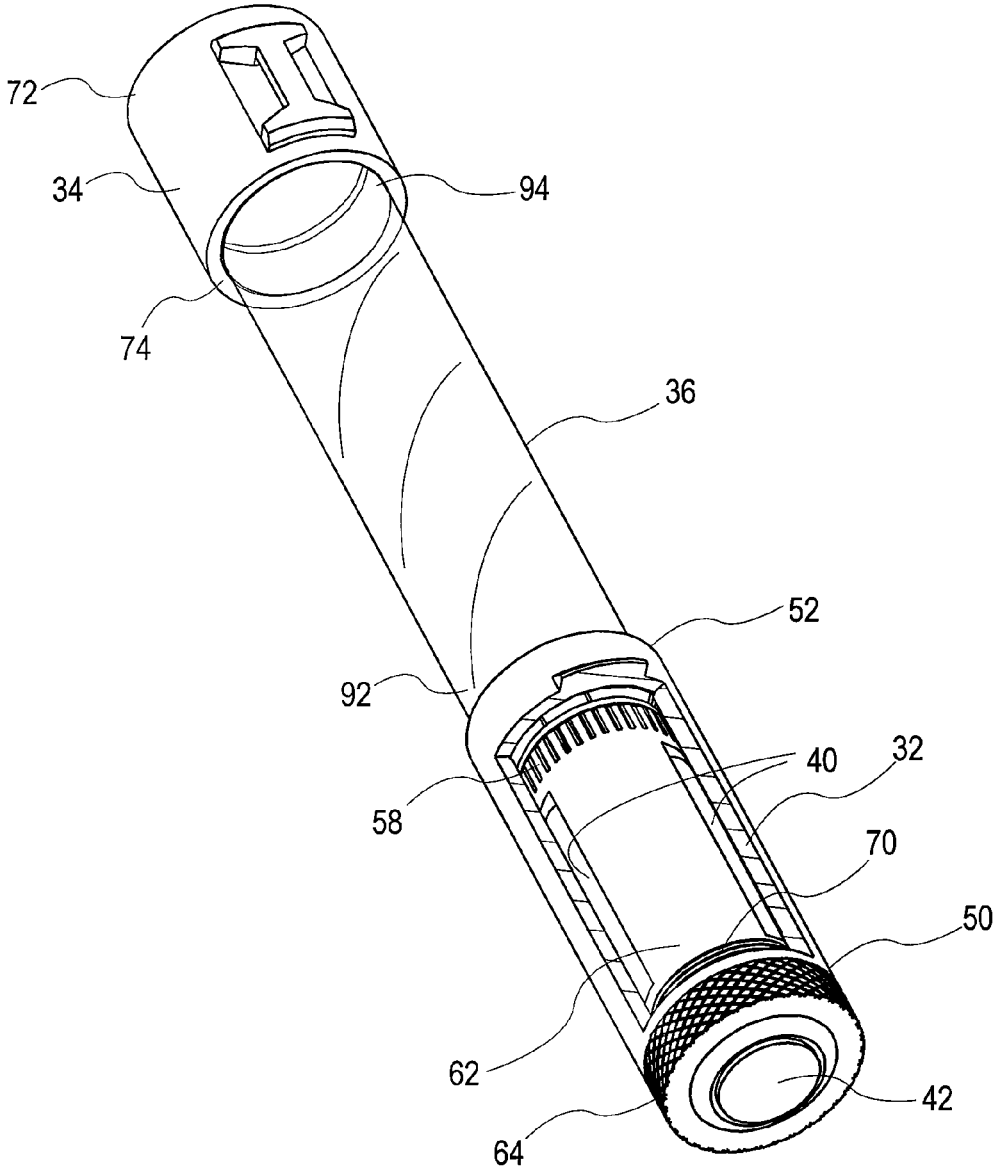
FIG. 4 is an isometric view of the light assembly shown in FIG. 1, having the first end segment cut away to show the interior portion, and absent the light source.
Figure 11:
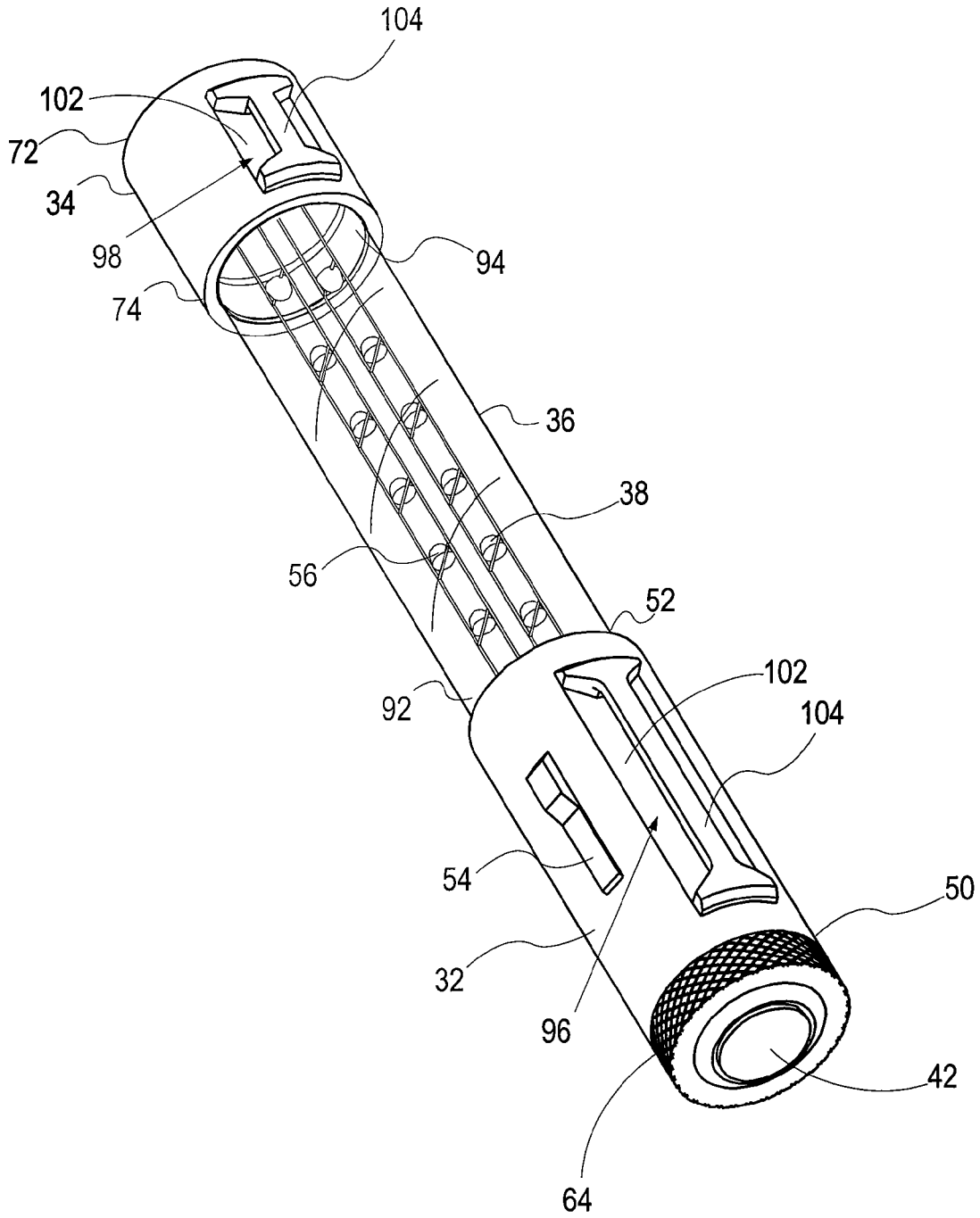
FIG. 11 is an isometric view of the light assembly of FIG. 1, showing multiple light sources and a switching device on the light assembly.

The activation mechanism 42 or device carried by the first end portion 32, as shown in FIGS. 1, and 3-4, is a push button assembly, which for example, includes one push of the button to activate and a second push of the button to deactivate. The activation device 42 may be generally commercially available. Examples may be available from Digi-Key Corporation (Thief River Falls, Minn.). The activation device 42 has the basic functions of engaging the light source 38 with a power source 40 or otherwise transmitting a current to operate the light source 38, and disengaging the light source 38 from a power source 40 or current. While a push button is illustrated by way of example, a rocker switch, rotational-type switch or other suitable activation device may be used without departing from the overall scope of the present invention. The activation mechanism 42 may further optionally include a mode switch 54 or mechanism to adjust the light between a steady or continuous lamp to a non-continuous, blinking, chasing, or flashing type light, or select between multiple light sources 38, 56. Similarly, a dimmer switch (not shown) may also be included with the activation mechanism 42 for adjusting the brightness or intensity of the light source 38 without departing from the overall scope of the present invention. As indicated, an additional switch or activation device 54 may be included on the housing to select between multiple light sources (see FIG. 11). As illustrated in FIGS. 1-4, the light source 38 generally is in communication with the activation mechanism 42 carried by the first housing segment 32. Further, the light source 38 may be in communication with the power supply 40. The light source 38 may be connected to the activation mechanism 42 or power supply 40 by wire or conductive contact 58, 60.

Figure 10A:
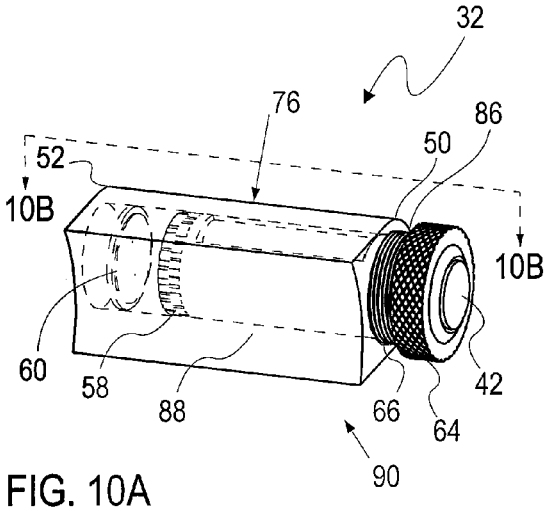
FIGS. 10A-10D are views of the end portions of the housing shown in FIG. 7 for use with the light assembly of FIG. 1.
Figure 10B:
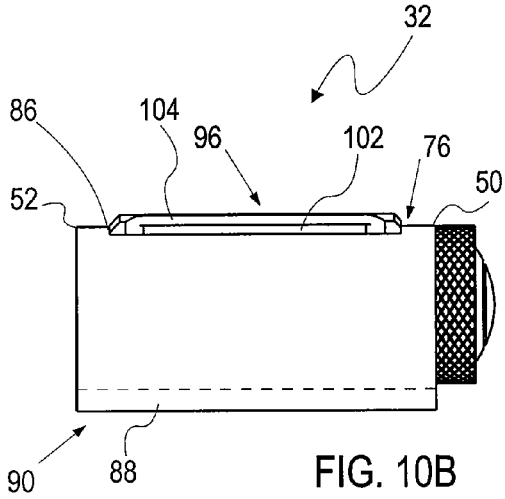
Figure 10C:
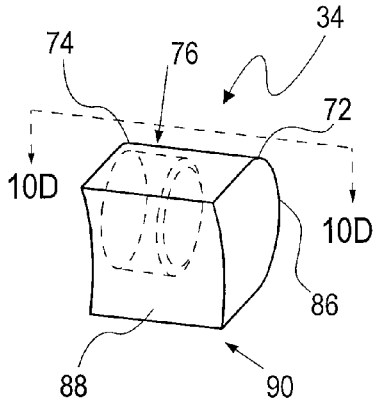
Figure 10D:
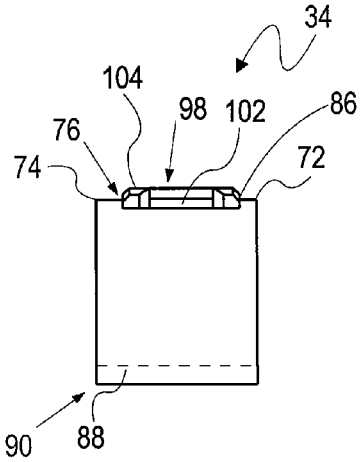

The first end portion 32 of the housing may also include an internal portion 62 positioned between the first end 50 and second end 52 for carrying a power supply 40 and/or the activation assembly 42. The internal portion 62 may be accessed by an end cap 64 carried by the first end 50 of the first housing segment 32. The end cap 64 is removable and may have a thread which mates with a corresponding thread 66 on housing. Alternatively, the housing may have an internal thread 68 that mates with a corresponding thread 70 on the internal portion 62 which is inserted into the housing (see FIGS. 3-4). Any suitable attachment mechanism, such as but not limited to a tongue an groove arrangement, or fastener such as but not limited to, a screw or clamp, may be acceptable for the purposes provided. For example, a friction fit, tongue and groove, or other mechanism for securing the end cap 64 to the housing is acceptable for the purposes provided. The end cap 64 may carry the activation device 42. The power supply 40 generally is in operable communication with the activation mechanism 42 and light source 38 to supply power to the light source 38 and thereby illuminate the light source. Communication may occur through, for instance, contact by the light source 38 with a contact switch or plate 58 or pins. To this end, a corresponding base connector 60 which is electrically connected to the light source 38 and is arranged to engage and transmit a signal or charge from the contact switch or plate 58 may also be provided. (see FIG. 10A showing a semi-transparent, partially exploded view). The power supply 40 may be a battery, including, but not limited to, alkaline, nickel cadmium, lithium ion, or nickel metal hydride, and/or a plurality of batteries. Further, the power supply 40 may be disposable or rechargeable. The power supply 40 may also be a renewable resource, such as a solar power assembly, which may further include one or more suitable solar collection devices on the housing (not shown).

As illustrated in FIGS. 1-4, the housing has a second end portion or second end segment 34. The illustrated second housing segment 34 is a cylindrical housing, although alternative geometries would not depart from the overall scope of the present invention. The second housing segment 34 has a first end 72 and a second end 74. The second end 74 is adapted to receive the central portion or light emitting segment 36 of the light assembly 30 substantially as described with respect to the first housing segment 32. The second end portion or housing segment 34 may be formed of metal, plastic, or other natural or synthetic substance.

Figure 5:
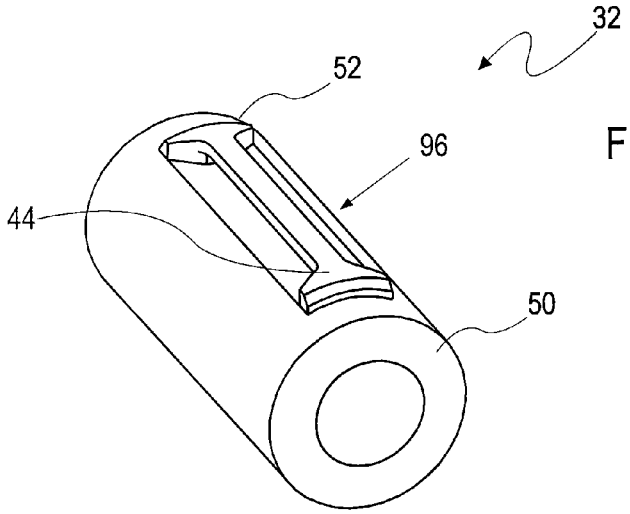
FIG. 5 is an isometric view of an end portion housing of the light assembly shown in FIG. 1, illustrating an end portion having a cylindrical shape according to one or more examples of embodiments.
Figure 6:
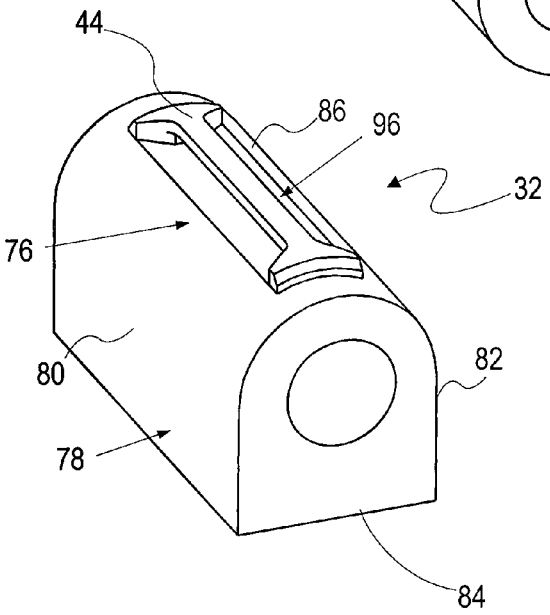
FIG. 6 is an isometric view of an end portion housing of the light assembly shown in FIG. 1, illustrating an end portion having an arcuate surface and a flat surface according to one or more examples of embodiments.
Figure 7:
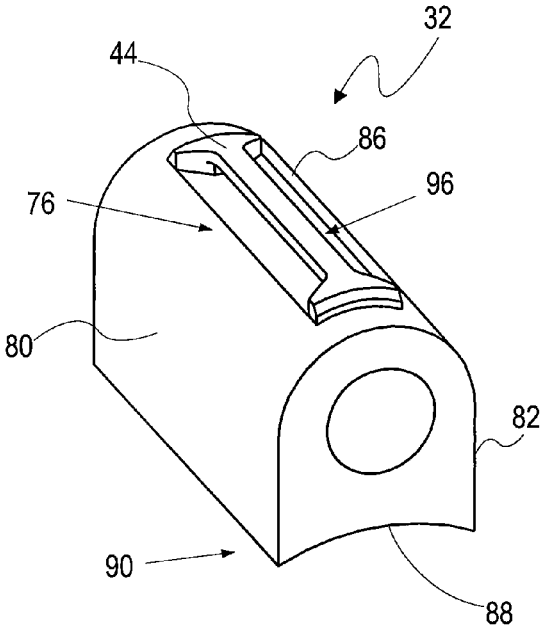
FIG. 7 is an isometric view of an end portion housing of the light assembly shown in FIG. 1, illustrating an end portion with two arcuate surfaces according to one or more examples of embodiments.
Figure 9:
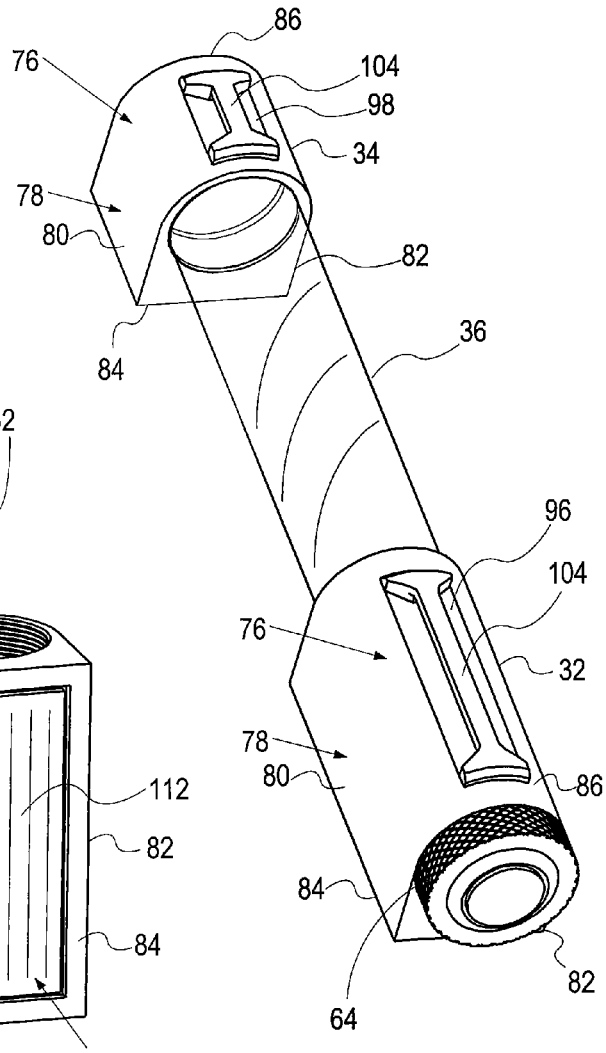
FIG. 9 is an isometric view of the end portions of the housing shown in FIGS. 6 and 8 in use on a light assembly of FIG. 1, absent the light source.

FIGS. 5-7 illustrate one or more examples of embodiments of the first and second end segments 32, 34 or portions of the housing. Specifically, each of the figures illustrate one or more examples of different embodiments of the first end segment 32 or portion which may include the activation mechanism 42 received by the first end, the geometric arrangement of the first housing segment 32, and an attachment assembly 44 carried by the first housing segment 32. However, the geometry of the illustrated end segment may be equally applied to the second end segment 34. The first end of the housing segment 32 shown in FIGS. 5-7 may further include an end cap 64. As shown in FIGS. 9-10A, the end cap 64 may be removable secured to the housing, allowing access to the interior, which for example, may include the power supply 40. The end cap 64 may carry the activation mechanism 42. The end cap 64 may be secured to the housing by any suitable means.

As indicated, although a first housing segment 32 is illustrated, it should be appreciated that the disclosed geometric arrangements may be equally applied to the second housing segment 34 or end portion, and therefore will not be further discussed in detail herein.

FIG. 5 illustrates an embodiment of the end portion or housing segment 32 wherein the housing portion is generally cylindrical between the first end 50 and second end 52. In one or more examples of embodiments, the cross section of the housing portion may be circular, an ellipse, partially parabolic, or offset to form an elliptic cylinder or oblique cylinder. While specific examples are given, the housing may be formed of alternative geometries or varying geometries in a single device without departing from the overall scope of the present invention.

Figure 8:
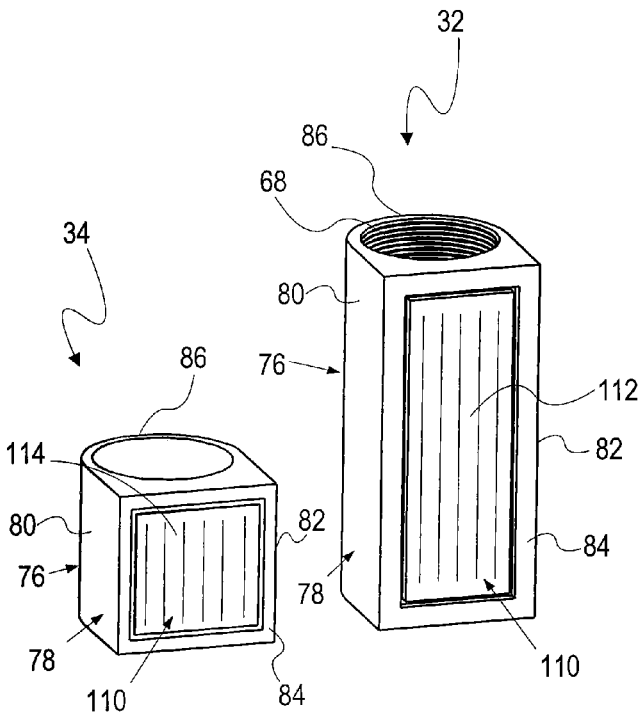
FIG. 8 is an isometric view of the end portions of the housing shown in FIG. 6 for use with the light assembly of FIG. 1, showing a magnetic attachment device.

FIGS. 6 and 8-9 illustrate an alternative embodiment of the end portion or housing segment 32. The housing portion shown in FIG. 6 generally includes a top portion 76 and a bottom portion 78. The top and bottom portion 76, 78 are generally integrally arranged. The bottom portion 78 may include a first flat sidewall 80, a second flat sidewall 82 and a flat bottom wall connecting the first and second sidewalls. The first flat sidewall 80, second flat sidewall 82 and flat bottom wall 84 generally form a rectangular arrangement. The top portion 76 may include a curved or arcuate portion 86 extending perpendicular to the length of the housing.

FIGS. 7 and 10A-10D illustrate an embodiment of the end portion or housing segment 32 wherein the housing segment is substantially as described as set forth in FIG. 6, but further including a second curved or arcuate portion 88. The first and second sidewalls 80, 82 and top arcuate portion 76, 86 are substantially identical to that illustrated in FIG. 6, and like numerals have been used to illustrate like components. To this end, the configuration generally includes a top arcuate portion 76 and a bottom portion 90. The top portion 76 and bottom portion 90 are generally integrally arranged. The bottom portion 90 has a curved or arcuate recess 88. In the illustrated example, the bottom portion 90 has first sidewall 80, second sidewall 82, and bottom arcuate wall 88. The arcuate wall curves toward the interior of the bottom portion so as to form a recess.

In one or more examples of embodiments, the first sidewall 80 and second sidewall 82 shown in FIGS. 6 and 7 may include alternative geometries, for example, but not limited to, curved, arcuate, or polygonal. In one or more examples of embodiments, the top 76 and bottom portions 78, 90 may have alternative geometric configurations, including, but not limited to four or more generally flat sides, two or fewer generally flat sides, and may be formed of alternative geometries, for example, but not limited to triangular, pentagonal, hexagonal or conical, without departing from the overall scope of the present invention. In one or more examples of embodiments, the housing may include two or more curved or arcuate recess surfaces or may include a curved or arcuate recess surface on the first or second sides.

The central portion 36 shown in FIGS. 1 and 3 is a cylindrical housing which forms the light emitting segment 36 of the housing. However, alternative geometries would not depart from the overall scope of the present invention. The light emitting segment 36 has a first end 92 and a second end 94. The central portion 36 may be formed of different lengths and different diameters or circumferences to account for different uses of the light assembly 30. The central portion or light emitting segment 36 may be formed of a generally rigid material. Alternatively, in one or more examples of embodiments, the central portion 36 may be flexible, enabling the central portion to bend or curve or change direction, and may be formed of a shape memory material. The central portion 36 or one or more of the housing segments 32, 34 may also include a hinged member (not shown) to permit bending or articulation of the light assembly 30 to adjust for angles or corners. The central portion 36 may also be formed of or include a high impact material, such as, but not limited to, plastic or metal and combinations thereof. The central portion or light emitting segment 36, or a portion thereof, is preferably transparent, or semi or partially transparent, or otherwise adapted to emit light or a wavelength of light. The transparent portion may thus be formed of a transparent material, such as, but not limited to, plastic or glass.

As illustrated in FIG. 1, the light emitting segment 36 or transparent portion surrounds or encapsulates or covers the entire circumference of the central portion 36. The first end 92 of the light emitting segment 36 is adapted to be received by the second end 52 of the first housing segment 32. The second end 94 of the light emitting segment 36 is adapted to be received by the second end 74 of the second housing segment 34. In this regard, the first and second ends 92, 94 of the light emitting segment 36 may be frictionally received, may have threaded portions, or may otherwise carry attachment members to mate with a corresponding attachment member or thread on the respective housing element. In one or more examples of embodiments, the transparent portion of the light emitting segment 36 may cover only a portion of the central portion or segment 36. Further, in one or more examples of embodiments, the transparent portion may be colored or tinted to emit light of specific color.

Carried between the first and second end segments 32, 34 and the light emitting section 36 may be an o-ring or gasket 93 (FIG. 2) or sealing ring. The gasket provides a tight seal between the segments 32, 34, 36 and reduces or eliminates water or air seepage into the interior of the assembly. A gasket or o-ring may also be provided between any cap and housing or otherwise between two separable segments.

Received within the light assembly 30, and specifically within the central portion 36 of the light assembly, is a light source 38. As shown in FIG. 1, the light source 38 may be a light-emitting diode (LED). The light source 38 may alternatively be an incandescent or compact fluorescent light bulb, infrared, ultraviolet or a black light, or a colored or tinted light bulb or source, or other device adapted to emit a wavelength of light. The light source 38 may be secured or connected at one end to the first housing segment 32 or to the conductive plate. The light source 38 may also be optionally secured to the second housing segment 34. In the illustrated example, the light source 38 is provided in a linear array extending from a first end of the light emitting segment 36 to the second end. However, variations on the array or pattern of light may be acceptable for the purposes provided. As previously described, the light source 38 is in operable communication or connection with the activation device 42.

A plurality of light sources may be provided. For example, in FIG. 11, a first light source 38 extending in a first linear array and a second light source 56 in a second linear array may be provided. The first and second light sources 38, 56 may be secured or connected at one end to the first housing segment 32, and may also be optionally secured to the second housing segment 34. The first and second light sources 38, 56 may be operably connected to the activation device 42, and may further be operably connected to a switching mechanism or switch 54 adapted to select between or switch the power supplied between the first and second light sources 38, 56, or to illuminate both light sources. While one and two light sources are specifically illustrated in a particular array, three, four and more light sources may be acceptable.

One or more attachment assemblies may be provided for attaching the light assembly 30 to a device so as to carry the light assembly thereon. In for example FIGS. 1, 2 and 12, two attachment assemblies 44, 46 are provided. The attachment assembly 44, 46 is formed by a first receptor 96 and a second receptor 98 and an attachment device 100. The first and second receptors 96, 98 are adapted to receive the attachment device 100 (see FIGS. 1 & 12). As illustrated in FIGS. 1 and 2, the first receptor 96 is carried by the first end segment 32 of the housing and the second receptor 98 is carried by the second end segment 34 of the housing. The first and second receptors 96, 98 include or are formed by a recessed portion 102 having a crossbar 104 extending across the recess, forming for example an aperture, to which the attachment device 100 can be secured. The crossbar 104 may be integrally formed with the housing or may be a separate element attached thereto. It is also contemplated that the crossbar 104 may not be connected to the housing on one end, enabling an attachment device 100 to slide and attach over an end of the crossbar 104. While two attachment assemblies are described, one, two, three, or more attachment assemblies may be used for the purposes provided herein.

Figure 14:
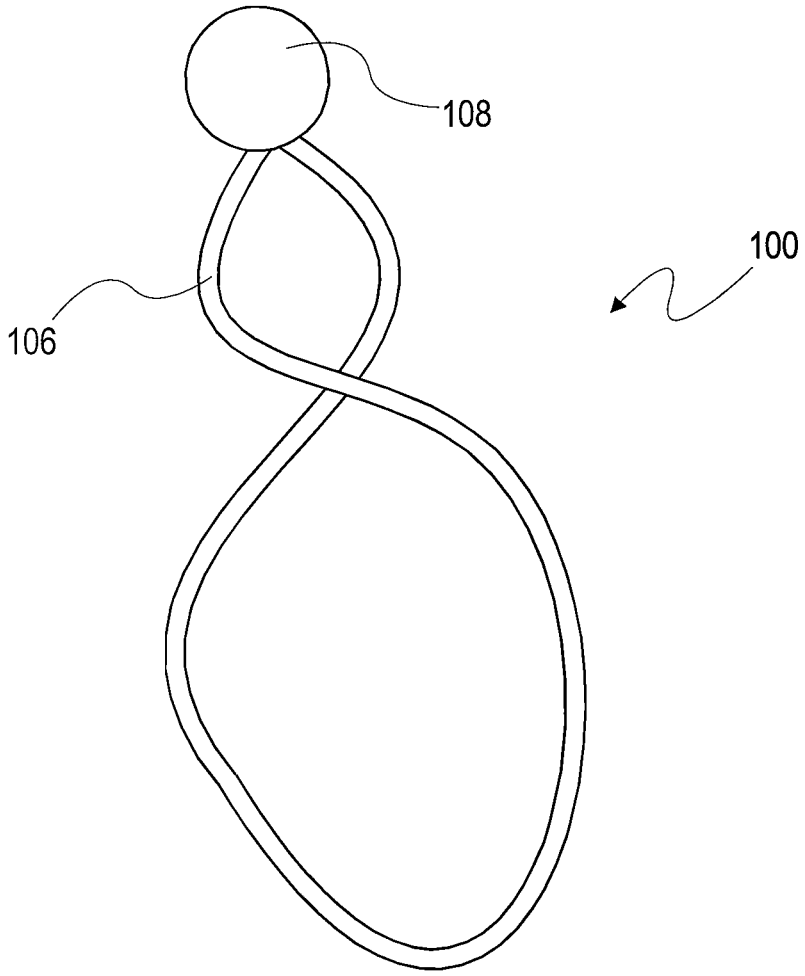
FIG. 14 is an isometric view of a closed-loop attachment device for attaching the light assembly of FIG. 1 to a carrying device.

The attachment member or device 100 may be any suitable device for securing the light assembly 30 to the carrying device 48. The attachment device 100 may be provided having a portion which may be received within the aperture or receptor 96, 98 of the attachment assembly 44, 46 on the housing of the light assembly 30. To this end, the attachment device 100 may have or include a cord, a strap, a hook, a tie, rope, string, or the like, and may be any other suitable permanent, semi-permanent, or temporary attachment device. For example, the attachment device 100 may be a hook and loop type fastener such as VELCRO®, or may be or include a zip tie. In another example, a closed-loop type fastener 100, such as shown in FIG. 14, may be used. The closed loop fastener 100 includes a cord 106 or rope section and has a securing device or coupling member 108. The closed-loop 100 may be formed of any suitable material of any acceptable length sufficient for the selected purpose to retain the light assembly 30 in place on the carrying device 48. In one or more examples, the cord 108 is formed of or includes a material having elasticity, such as but not limited to rubber, neoprene, or bungee-style of cord, while the coupling member 108 is formed of a plastic or metal or wooden structure larger in size to the cord. The securing device or coupling member 108 for the closed loop illustrated in FIG. 14 is a ball end. Alternative non-limiting examples of coupling members may be buckles, ties, pins, mating structures, and the like.

As illustrated in FIGS. 8 and 9, the housing or a portion thereof may include a magnetic attachment assembly 110. For example, a first magnet 112 may be provided on a first end segment 32 of the housing and a second magnet 114 may be provided on a second end segment 34 of the housing. Alternatively or in addition, the magnetic attachment assembly 110 may be provided on a portion of the center portion or light emitting segment 36 and may extend a distance between the first end and second end 92, 94 of the center portion 36. The magnetic attachment assembly 110 or first and second magnets 112, 114 may be one or more permanent magnets or electromagnets. In one or more examples of embodiments, a plurality of magnetic attachment assemblies may be attached or otherwise secured within or to the housing. The magnetic attachment assembly 110 may be used alone or in combination with the other attachment assemblies 44, 46 described herein.

Figure 13:
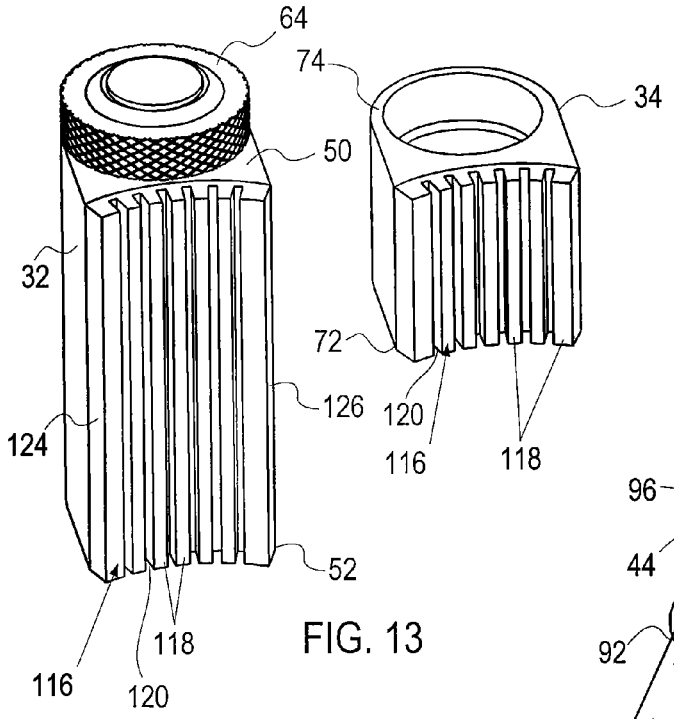
FIG. 13 is an isometric view of a light assembly as shown in FIG. 1, including the housing segments shown in FIG. 13 and secured to a carrying device.

The housing or a portion 32, 34, 36 thereof may also include a gripping member 116 (see FIG. 13). The gripping member 116 is formed of a flexible or semi-flexible material and may include a sticky surface or be formed of a material that is resistant to sliding movement along a surface, such as a metal surface. The material may also be compressible. Examples of suitable materials include rubber and plastic material, however, any material accomplishing the foregoing purposes may be acceptable. The gripping member 116 is arranged in FIG. 13 to have a series of spaced apart fingers 118 or channels 120. The fingers 118 are arranged in an arcuate pattern in FIG. 13 to correspond to a shape of a curved frame element 122 (see FIG. 12), although an arcuate pattern is not required. The gripping member 116 may be further sized so that the distance between the outer edges 124, 126 of the gripping member 116 is slightly narrower than the width or diameter of the carrying device 48 to which it may be attached. As a result, the gripping member 116 may "grip" the carrying device 48 by the flexible compression of the fingers 118.

The light assembly 30 may be assembled by into the form described herein. As shown in the Figures, the first segment 32, second segment 34 and light emitting segment 36 may generally have a corresponding geometry. In one or more examples, as shown in FIGS. 1-4, the first end housing segment 32 is secured, such as by engagement or mating the end 32 to the light emitting section 36. The second end housing segment 34 is secured, such as by engagement or mating the end 34 to the light emitting section 36. In this regard, the first and second end housing segments 32, 34 may be removably received on or carried by the light emitting segment 36. Prior to securing the housing end segments 32, 34, a gasket may be optionally placed between an end segment and the light emitting segment.

As illustrated in FIG. 1, the central portion or light emitting segment 36 may removably receive a light source 38 into an internal cavity 128 formed in the central portion 36. The light source 38 may be one or more light emanating devices as described hereinabove. The light source 38 is preferably attached to the first housing segment 32 prior to complete assembly of the housing from the attachment of the first housing segment 32, second housing segment 34, and light emitting segment 36. The light source 38 may be attached by commercially known means suitable for attachment and connection and/or activation with a power supply 40. Once the light source 38 is attached, the housing may be fully assembled as previously described.

A housing segment 32, 34, or both housing segments may be optionally sealed or attached to the central portion 36 by, for example an adhesive or fastener. In an additional alternative embodiment, one or both of the first and second attachment assemblies, and in particular receptors 96, 98, may be molded to or integrally formed with the first and second end segments 32, 34. In one or more examples of embodiments, the first and second attachment assemblies as well as the first and second housing segments 32, 34 and light emitting segment, may be connected by, for example, but not limited to, a band clamp or a pressure clamp.

Figure 15:
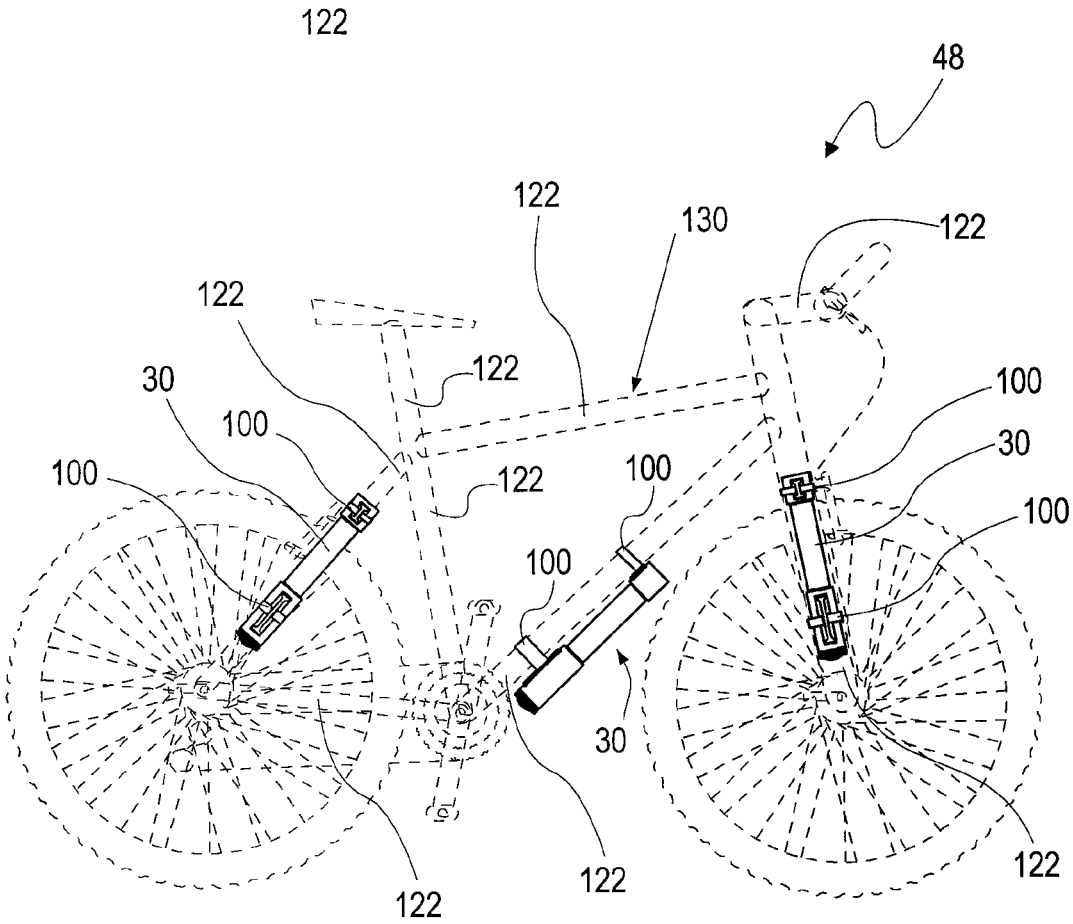
FIG. 15 is a side elevation view of a bicycle having the light assembly of FIG. 1 attached, illustrating one or more examples of attachment on various locations.

In operation and use, the light assembly 30 may be connected or attached to a carrying device 48 in the form of a vehicle. As shown in FIG. 15, in which the vehicle is a bicycle 130, the light assembly 30 may be connected to various locations or frame elements 122 along the bicycle 130, including, but not limited to, the bicycle frame, forks, seat posts, and handlebars.

Figure 12:
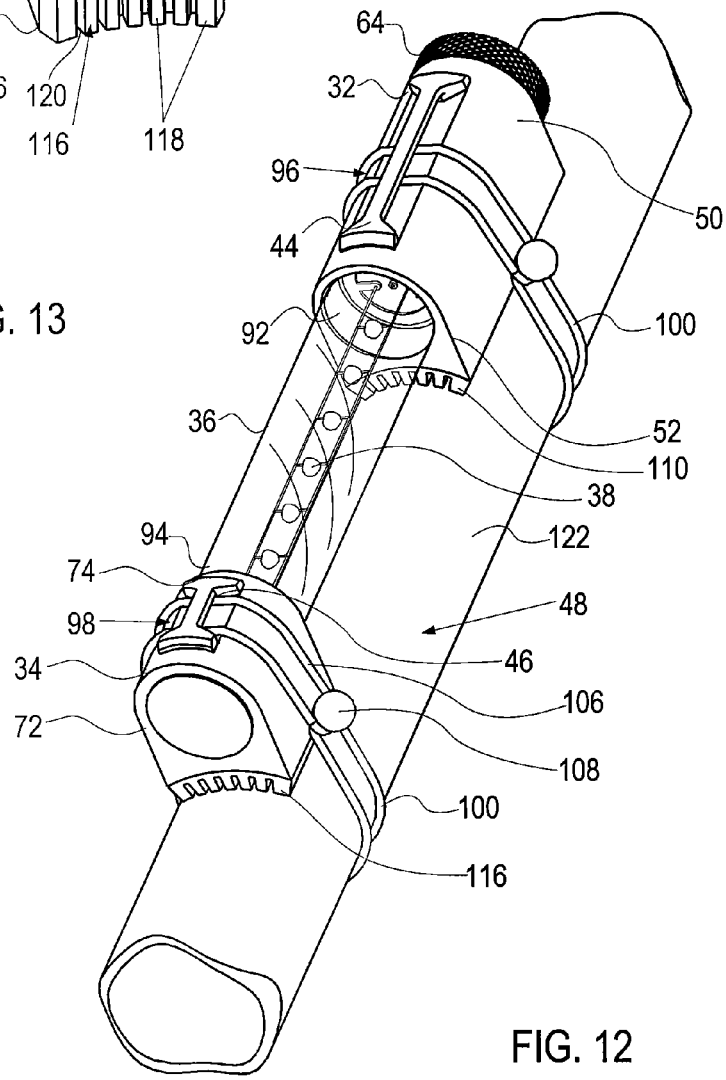
FIG. 12 is an isometric view of the first and second end housing segments for use with the light assembly shown in FIG. 1, showing a gripping member.

Referring to FIG. 12, the light assembly 30 includes an attachment assembly 44, 46 arranged for attachment of the light assembly to at least a portion of a bicycle frame element 122 so as to outline at least a portion of the frame. In this regard, the light assembly 30 or bicycle safety light attachment assembly 44, 46 may have a fastener or attachment device 100 attached to the first end segment 32 of the housing and arranged to surround a portion of the bicycle frame element 122, and a second fastener or attachment device 100 attached to the second end segment 34 of the housing and arranged to surround a portion of the bicycle frame element 122, wherein the attachment assembly 44, 46 is arranged for easy assembly and disassembly. The light assembly 30 may be generally aligned along any suitable location or portion of the bicycle 130. For example, as shown in FIG. 15, the light assembly 30 may be attached or aligned along any of the frame elements 122 of the bicycle 130. A light assembly 30 having first or second end portions or segments 32, 34 with a curved or arcuate portion 88, as shown in FIGS. 7, 10A-10D, and 12-13, may receive a rounded structure or curved portion of a frame element 122 in the arcuate portion 88 of the end segment 32, 34 for connection with the vehicle. In one or more examples of embodiments, the light assembly 30 includes a gripping member 116 (see FIGS. 12 & 13), which may be aligned on the frame element 122 for gripping the bicycle 130 when in use. The gripping member 116 may be arcuate and/or sized smaller than the shape of the frame element 122 so as to "grip" the frame when the light assembly 30 is pressed onto or placed on the frame element 122. Alternatively, the light assembly 30 may include a magnetic attachment mechanism 110 (FIG. 8) which attracts to the frame element 122. In addition, or in the alternative, the user may attach or secure the light assembly 30 to the selected location by passing an attachment device 100 through the first aperture formed by the receptor 96 of the first attachment assembly 44, followed by surrounding, entrapping or attaching the attachment device about the location of the bicycle 130 (FIG. 12, 15). To further secure the light assembly 30 to the bicycle 130, the user may pass an attachment device 100 through the second aperture formed by the receptor 98 of the second attachment assembly 46, followed by attachment to the location of the bicycle 130. As one non-limiting example, a VELCRO® strap may be used which is inserted into the receptor 96, 98, wrapped around a frame element 122 and then secured to itself in the known manner. In another non-limiting example, a closed-loop type fastener 100 may be used, in which one end of the loop is passed through the receptor 96, 98, then wrapped around the frame and over a coupling member 108 carried by the closed-loop 106, such as a ball end (FIG. 12, 14).

Figure 16:
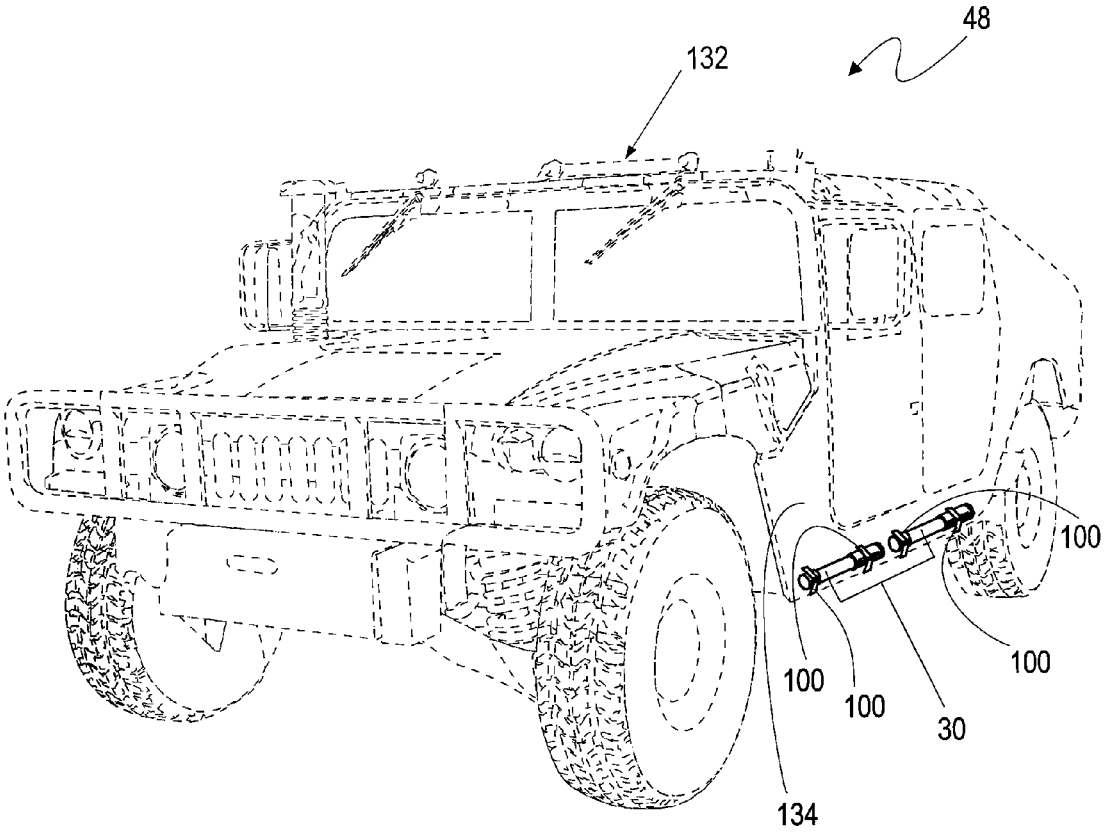
FIG. 16 is an isometric view, showing the light assembly of FIG. 1 attached to a vehicle in one or more examples of alternative embodiments.
Figure 17:
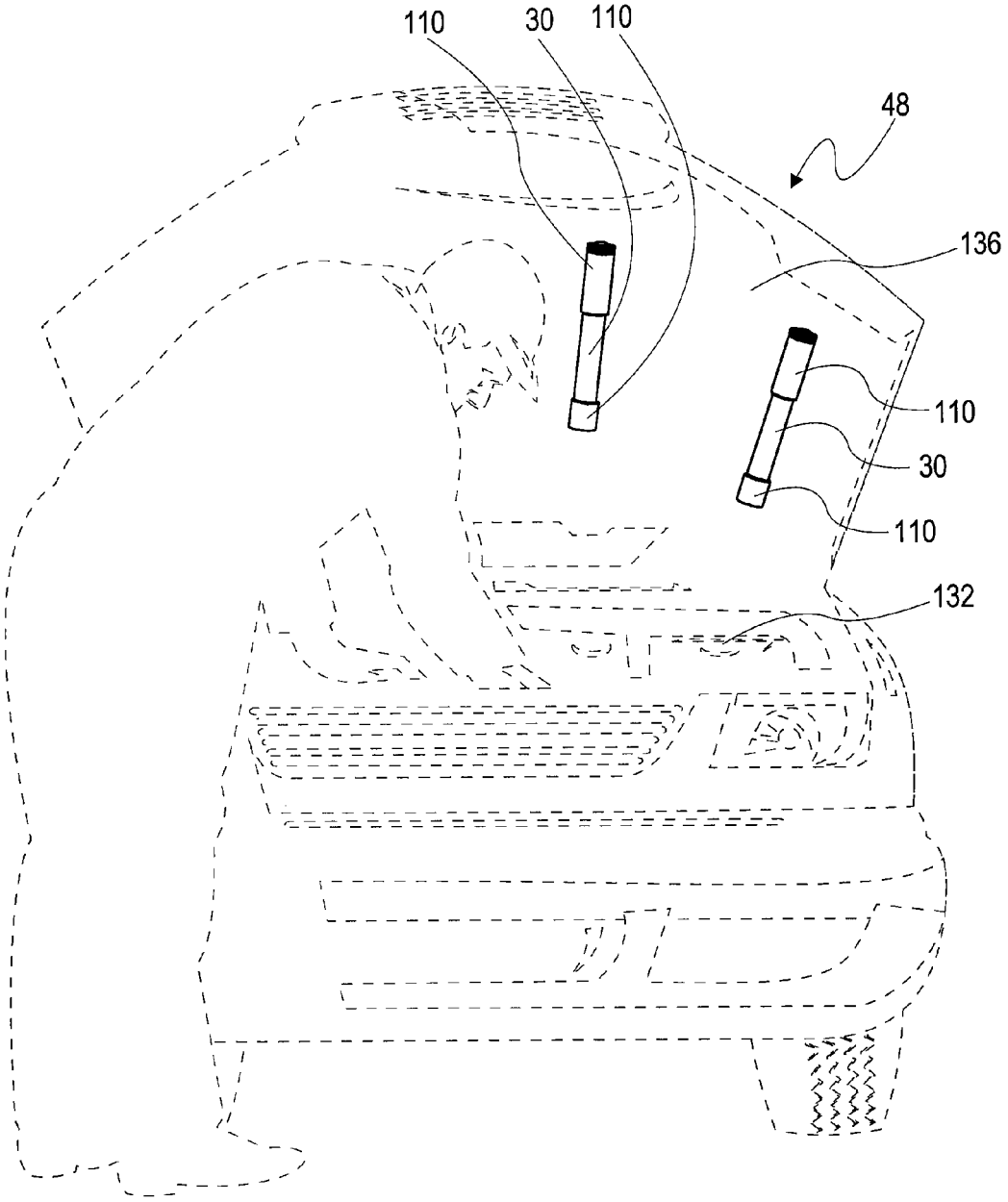
FIG. 17 is an isometric view, showing the light assembly of FIG. 1 attached to a vehicle in one or more examples of alternative embodiments.

In one or more examples of embodiments, and illustrated in FIG. 16, the carrying device 48 or vehicle may be a motor vehicle 132, and may be a military vehicle, such as but not limited to a HUMVEE®. Further, in one or more examples of embodiments, the vehicle may be a car, truck, motorcycle, wagon, tractor, implement, scooter, moped, skateboard or other currently known or later developed motorized or human propelled vehicle. The illustrated attachment locations include to the outer surface 134 (FIG. 16) and under the hood 136 (FIG. 17) of a motor vehicle 132, however, it is contemplated that any magnetic attachment to any metallic portion of the motor vehicle or attachment by non-magnetic attachment device as previously described herein is acceptable for the purposes provided. The light assembly 30 may be connected to a metal portion of a vehicle by magnetic attachment or attraction of the magnetic attachment assembly 110. For example, the light assembly 30 having first or second end portions 32, 34 with one or more generally flat surfaces 84, as shown in FIGS. 6 and 8-9, may have one or more magnetic attachment assemblies 110 connected to the one or more generally flat surfaces. This may provide one or more surfaces to magnetically attach to or attract to a metal portion of a vehicle. Alternatively, or in addition, assemblies 44, 46 may be used. While a specific light assembly housing is described in this example, any light assembly carrying a magnetic attachment assembly 110 is acceptable for the purposes provided.

In one or more examples of embodiments, the light assembly 30 may be connected or attached to a person or person's apparel or other garment which forms the carrying device 48. For example, the light assembly 30 may be positioned around the neck of a person through the use of a lanyard. The lanyard may be formed of natural or synthetic fibers or textiles. The lanyard may be connected to the first or second apertures 96, 98 of the first or second attachment assemblies 44, 46. For example, the lanyard may include a hook or clamp structure which may be removably received by the first or second apertures. In one or more examples of embodiments, the lanyard may be received or threaded through the first or second apertures 96, 98. Once the lanyard is connected to the light assembly 30, the user may place the lanyard around a neck, wrist, or other body part sufficient to retain the lanyard. Multiple lanyards, connected to multiple attachment assemblies or receptors may also be used.

Figure 18:
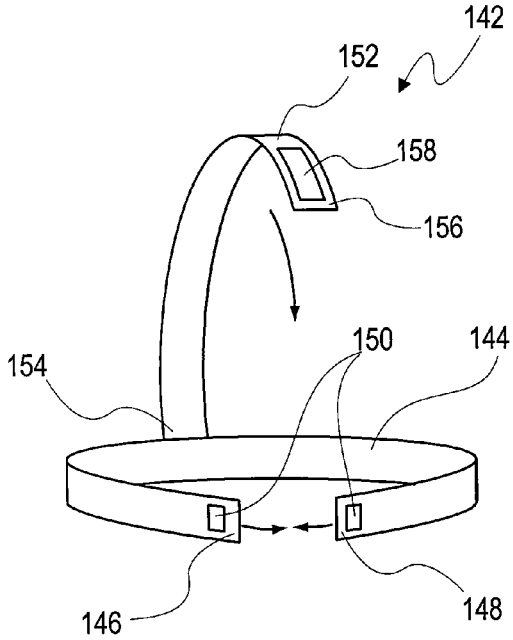
FIG. 18 is an isometric view of a strap assembly for attaching the light assembly of FIG. 1 to a person.

As shown in FIGS. 18-21, the light assembly 30 may be connected or attached to the garment or apparel 138 of a person or to the person 140 directly which forms the carrying device 48, such as by for example a strap or neoprene strap. FIG. 18 illustrates one example of a garment, namely, a strap assembly 142 or belt assembly for carrying or attaching or wearing the light assembly 30 on a person. The strap assembly 142 may include a first portion 144, generally arranged horizontally, for connection or attachment around the waist of a person. The first portion may have a first end 146 and a second end 148. The first end 146 and second end 148 may connect to form a belt like structure 150. To this end, the first and second ends 146, 148 may have a latch, buckle, or connection device 150 to connect the first and second ends. The connection device 150 may also be adjustable to enable adjustment of the circumference of the first portion. The strap assembly 142 may also include a second portion having a first and second end. The second portion 152 may be arranged generally perpendicular to the first portion 144. The first end 154 of the second portion may be attached or connected to the first portion 144. The second portion 156 may extend from the first end, along the body of the person, and then over the shoulder of the person so the second end 156 is arranged on the opposite side of the body of the person as the first end of the second portion. The second end 156 may have an attachment device 158 for removable attachment to one or more of the attachment assemblies of the light assembly 30. Two said second portions 152 may also be provided (see FIG. 19). The strap assembly 142 may be formed of neoprene, or other natural or synthetic textile, rubber or fabric and may include any suitable buckle or securing mechanism. In one or more examples of embodiments, the strap assembly 142 generally may include a circular portion having an appendage aperture for removably receiving an appendage of a person. The strap assembly 142 may also include a connection portion 160 for connection or attachment to the attachment assembly 44, 46 of the light assembly 30. For example, a strap, loop, hook, or plurality of such structures may be provided on any one or more housing segments or portions to which a light assembly 30 may be secured via the attachment assemblies described herein.

Figure 19:
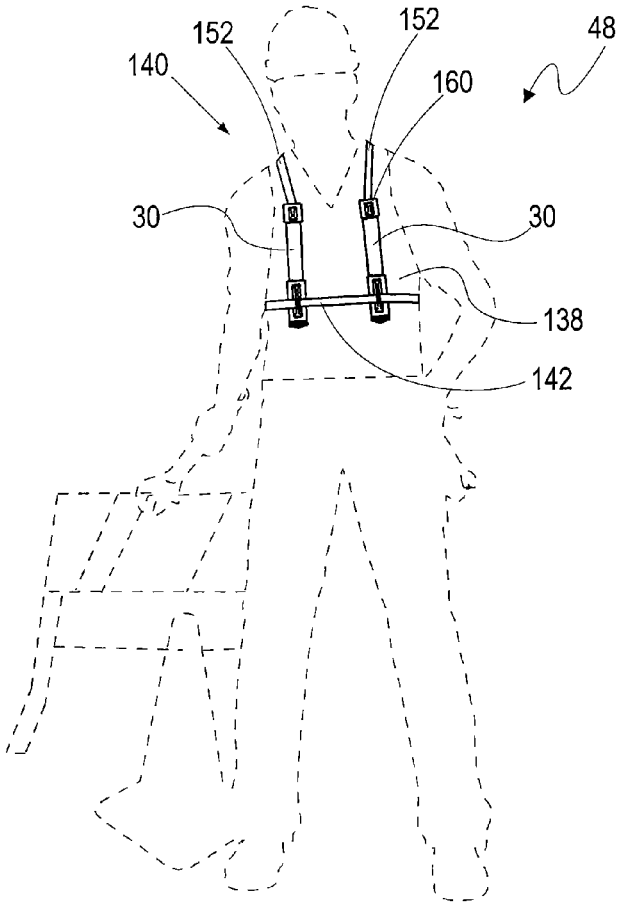
FIG. 19 is a side elevation view, showing the light assembly of FIG. 1 attached to a person, illustrating one or more examples of embodiments of the light assembly connected to a vest or garment worn on the torso of a person.
Figure 20:
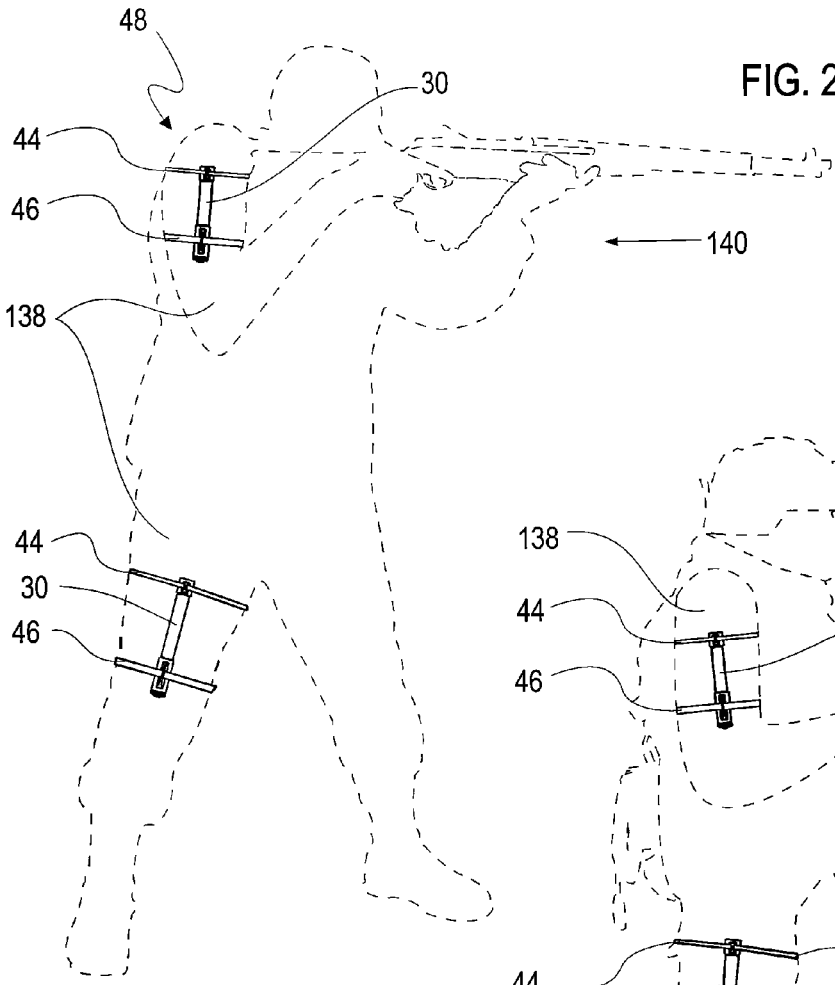
FIG. 20 is a side view elevation view, showing the light assembly of FIG. 1 attached to a person, for example a hunter, illustrating the light assembly attached to one or more different appendages and illustrating light assemblies of different lengths.
Figure 21:
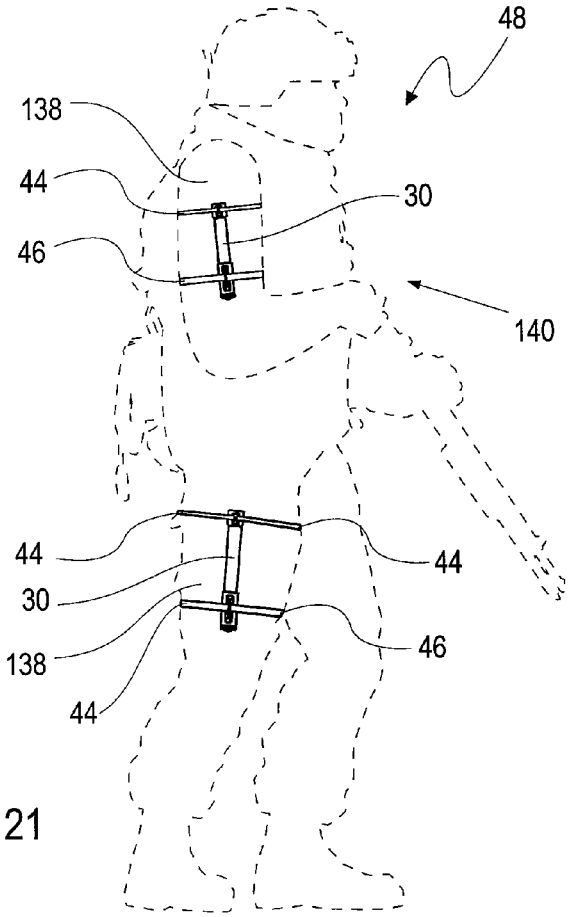
FIG. 21 is a side view elevation view, showing the light assembly of FIG. 1 attached to a person, for example a soldier, illustrating the light assembly attached to one or more different appendages and illustrating light assemblies of different lengths.

As illustrated in FIG. 19, a person 140 may have the light assembly 30 attached to the torso. The light assembly 30 may be attached to standard clothing 138, or may be attached to a specially designed vest with structure to removably receive or carry the light assembly. The light assembly 30 may also be attached to the appendage of a person 140. As illustrated in FIGS. 20 and 21, the light assembly 30 may be attached to one or more arms and/or one or more legs of a person 140. The light assembly 30 may be connected or strapped to the appendage through use of the first and second attachment assemblies 44, 46. For example, a strap may extend around the appendage. Alternatively, the garment 138 or the garment appendage may be provided with a loop, hook, strap, or plurality of such structures to which the attachment assembly 44, 46 may be connected. In one or more examples of embodiments, the light assembly 30 may be attached to the body or appendage of a person 140 by a strap assembly 142 as shown in FIG. 18. Attachment may occur by any suitable means for securing the attachment assemblies to a carrying device 48 described herein.

In one or more examples of embodiments, the light assembly first or second attachment assemblies 44, 46 may include a single connection point to the light assembly, specifically either the first or second ends of the first or second attachment assemblies, enabling slidable attachment of the light assembly 30. The user may slidably attach the light assembly 30 to a garment, for example, but not limited to, a shirt pocket, pant pocket, belt, arm pocket, vest, or other appendage portion of a garment.

Figure 22:
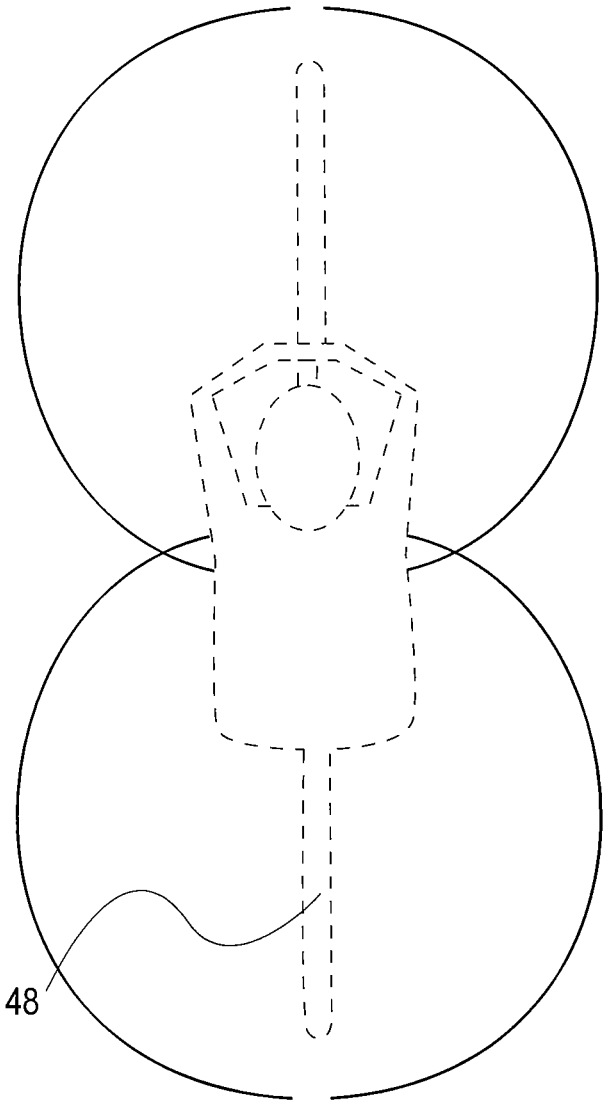
FIG. 22 is a top plan view or overhead view, showing use of the light assembly of FIG. 1 on a bicycle and illustrating an example of light emission by the light assemblies arranged as shown in FIG. 15.

Once attached, the user may actuate the activation mechanism 42 to begin operation of the light assembly 30. Upon actuation, energy from the power supply 40 will flow to the light source 38, powering the light source to emit light. For example, as illustrated in FIG. 22, where the light assembly 30 is attached to a bicycle 130, the light source 38 will release light energy in a plurality of directions. In one or more examples of embodiments, the user may actuate the mode switch 54 to adjust the emanating light between a steady lamp to a blinking, chasing, or flashing type light. Further, in one or more examples of embodiments, the user may actuate a dimmer switch to adjust the brightness or intensity of the light. In one further embodiment, the user may actuate a switch 54 to select between multiple light sources 38, 56 carried within the light assembly 30. For example, a user may select between visible light and infrared light.

There are several advantages to the light assembly. The user may be illuminated during low sunlight or light conditions, allowing others to recognize and see the user. This protects the user from possible injury caused by others not seeing or recognizing the user. Likewise, the light assembly is removable, allowing multiple uses of a single assembly. A user may wear the light assembly on the person and later attach the same assembly to a vehicle. The light assembly may be reusable. The light source and power supply may be easily replaced, and the emission of light is not limited to a finite period of time before disposal. The light assembly may allow for different light sources for different purposes. The light assembly may allow the user to exchange light sources from an illumination source emitting white light to an infrared emitting source for example, as may be required for military night activities. The light assembly may be readily turned on or off through actuation of the activation mechanism. This allows a user to have control regarding whether they wish to be illuminated. The light assembly may have an improved attachment assembly, including a light housing having different or multiple geometries, to increase the variety of surfaces the light assembly may be attached. This allows a user more freedom to secure the light assembly to more surfaces, allowing the user to select attachment locations and attachment devices for a single light assembly, and allowing illumination of low light areas which ordinarily would not be effectively illuminated. The light assembly, or safety light, or light emitting device according to the foregoing provides a light or illumination device and mounting assembly which may connect to a vehicle or person, is removable, generally illuminates a vehicle, area or person for recognition by others, and is reusable.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references, including but not limited to, upper, lower, upward, downward, left, right, leftward, rightward, top, bottom, above, below, vertical, horizontal, clockwise, counterclockwise, x-axis, y-axis, and z-axis, central, are only used for identification purposes to aid the reader's understanding of the embodiments of the present invention, and do not create limitations, particularly as to the position, orientation, or use of the invention unless specifically set forth in the claims. Joinder references (e.g., attached, coupled, connected) are to be construed broadly and may include intermediate members between a connection of elements and relative movement between elements. As such, joinder references do not necessarily infer that two elements are directly connected and in fixed relation to each other.

In some instances, components are descried with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to preferred embodiments, persons skilled in the art will recognize that changes may be made in form and detail without departing from the spirit and scope of the invention.

What is claimed is:

1. A light assembly comprising:

a housing having a first housing segment, a second housing segment, and a central portion coupling the first and second housing segments, wherein the first housing segment includes a first outer surface having a first concave gripping member, the first concave gripping member being defined by a plurality of alternating projections and channels, and the second housing segment includes a second outer surface having a second concave gripping member, the second concave gripping member being defined by a plurality of alternating projections and channels, the first and second concave gripping members being adapted for gripping a rounded surface;

an activation device and a power source carried by the first housing segment;

a transparent cylindrical housing forming the central portion and encapsulating the entire circumference of a light source within the cavity of the cylindrical housing, the light source being connected at one end to the first housing segment and extending in a linear array to the second housing segment, the light source also being in electrical communication with the activation device and arranged to illuminate the entire central portion so as to radiate light cylindrically outward from the central portion; and an attachment assembly arranged for attachment of the light assembly to an attachment device, the attachment assembly formed by a first crossbar coupled to the first housing segment, the first crossbar extends across and overlaps a portion of a first recess provided on the first housing segment to define a first slot provided between the first crossbar and the first recess, the first slot is adapted to receive a portion of the attachment device.

2. The light assembly of claim 1, wherein the first housing segment and the second housing segment are separable from the central portion of the housing.

3. The light assembly of claim 1, wherein the first housing segment has a first flat surface, and the second housing segment has a second flat surface, the first and second flat surfaces forming an engaging surface, the engaging surface carrying a magnet.

4. The light assembly of claim 1 wherein the attachment device is a hook and loop type fastener.

5. The light assembly of claim 1, wherein the attachment device is a closed loop type fastener.

6. The light assembly of claim 1, further comprising a plurality of light sources within the cavity of the cylindrical housing connected at one end to the first housing segment and extending in a linear array to the second housing segment, and a switch assembly arranged to select from the plurality of light sources to illuminate the light emitting segment.

7. The light assembly of claim 1, wherein the light source emits continuous, steady light.

8. The light assembly of claim 1, wherein the light source emits non-continuous light.

9. A bicycle having a frame formed of a plurality of frame elements, the bicycle forming a carrying device, the light assembly of claim 1 being secured to one of the plurality of frame elements by the attachment assembly.

10. A garment having a surface, the garment forming a carrying device, the light assembly of claim 1 secured to the surface of the garment by the attachment assembly.

11. The light assembly of claim 1, wherein the attachment device is a first attachment device and the attachment assembly further comprises a second crossbar coupled to the second housing segment, the second crossbar extends across and overlaps a portion of a second recess provided on the second housing segment to define a second slot provided between the second crossbar and the second recess, the second slot is adapted to receive a portion of a second attachment device.

12. The light assembly of claim 1, wherein the first crossbar is coupled to the first housing segment by a connection portion, the first crossbar is narrower than the connection portion such that the attachment assembly forms a generally T-shaped member.

13. The light assembly of claim 1, wherein the first crossbar is coupled to the first housing segment by a first connection portion and a second connection portion, the first and second connection portions are provided at opposing ends of the first crossbar, the first crossbar is narrower than the first and second connection portions such that the attachment assembly forms a generally H-shaped member.

14. A light assembly comprising:

a housing having a first housing segment, a second housing segment, and a central portion coupling the first and second housing segments, wherein the first housing segment includes a first outer surface having a first gripping member, the first gripping member being defined by a plurality fingers projecting from the first outer surface, and the second housing segment includes a second outer surface having a second gripping member, the second gripping member being defined by a plurality of fingers projecting from the second outer surface;

an activation device and a power source carried by the first housing segment;

a transparent cylindrical housing forming the central portion and encapsulating a light source within the cavity of the cylindrical housing, the light source being connected at one end to the first housing segment and extending in a linear array to the second housing segment, the light source also being in electrical communication with the activation device and arranged to illuminate the central portion so as to radiate light outward from the central portion; and an attachment assembly arranged for attachment of the light assembly, the attachment assembly formed by a first crossbar coupled to the first housing segment, the first crossbar overlaps a portion of a first recess provided on the first housing segment to define a first slot provided between the first cross bar and the first recess, the first slot being adapted to receive a portion of a first attachment device, and a second crossbar coupled to the second housing segment, the second crossbar overlaps a portion of a second recess provided on the second housing segment to define a second slot provided between the second cross bar and the second recess, the second slot being adapted to receive a portion of a second attachment device.

15. The light assembly of claim 14, wherein the first housing segment and the second housing segment are separable from the central portion of the housing.

16. The light assembly of claim 14, wherein the first housing segment has a first flat surface, and the second housing segment has a second flat surface, the first and second flat surfaces forming an engaging surface, the engaging surface carrying a magnet.

17. The light assembly of claim 14 wherein the first and second attachment devices are selected from the group consisting of a hook and loop type fastener and a closed loop type fastener.

18. The light assembly of claim 14, further comprising a plurality of light sources within the cavity of the cylindrical housing connected at one end to the first housing segment and extending in a linear array to the second housing segment, and a switch assembly arranged to select from the plurality of light sources to illuminate the light emitting segment.

19. The light assembly of claim 14, wherein the light source emits continuous, steady light.

20. The light assembly of claim 14, wherein the light source emits non-continuous light.

* * * * *